US007624863B2

(12) United States Patent
Meng

(10) Patent No.: US 7,624,863 B2
(45) Date of Patent: Dec. 1, 2009

(54) TOOLBOX STRUCTURE

(76) Inventor: Chi-Fen Meng, P.O. Box 215, Taichung City (TW) 40099

( * ) Notice: Subject to any disclaimer, the term of this patent is extended or adjusted under 35 U.S.C. 154(b) by 330 days.

(21) Appl. No.: 11/704,283

(22) Filed: Feb. 9, 2007

(65) Prior Publication Data

US 2008/0164171 A1 Jul. 10, 2008

(30) Foreign Application Priority Data

Jan. 5, 2007 (TW) ..... 96200263 U

(51) Int. Cl.
*B65D 85/26* (2006.01)
*B65D 6/40* (2006.01)

(52) U.S. Cl. ..... 206/349; 206/372; 220/4.22

(58) Field of Classification Search ..... 206/349, 206/377, 379, 378, 370, 373, 372, 375; D3/294, D3/905; 220/4.21, 4.22, 4.23, 4.24, 4.01, 220/4.03, 4.26, 4.34, 4.33, 503, 507, 529, 220/4.28, 4.32

See application file for complete search history.

(56) References Cited

U.S. PATENT DOCUMENTS 5,669,503 A * 9/1997 Robin ..... 206/528
5,775,499 A * 7/1998 Budert ..... 206/379
6,533,138 B2 * 3/2003 Chwen-Ru ..... 220/522
6,547,074 B1 * 4/2003 Chen ..... 206/379
6,988,616 B2 * 1/2006 Chen ..... 206/379
7,168,559 B2 * 1/2007 Chen ..... 206/373
2004/0256265 A1 * 12/2004 Pangerc et al. ..... 206/370

* cited by examiner

*Primary Examiner*—Ehud Gartenberg
*Assistant Examiner*—Ernesto A Grano

(57) ABSTRACT

A toolbox structure is used to mainly contain driver bits. It mainly comprises: a main container that has multiple storing slots on both of its longer sides for containing driver bits, two curved wall on the top, and a pivot connector; left and right containers are located on both sides of the main container, have recessing windows with multiple positioning slots inside that match with the storing slots of the main container, and have left and right fitting rings on the top respectively, and left and right shaft holes on the bottom respectively for fitting purpose. The left and right containers can thus, given the pivot connector as the pivot axis, rotate against the main container to open up or close the toolbox for loading or unloading driver bits.

11 Claims, 19 Drawing Sheets

TOOLBOX STRUCTURE

BACKGROUND OF THE INVENTION

In order to improve the operating conveniences and capabilities of toolboxes when users use them, this invention proposes a toolbox structure that can contain driver bits with firm positioning, and perform different dimension shifts for easy carry-on.

SUMMARY OF THE INVENTION

This invention proposes a toolbox structure that is easily assembled with fewer components and lower manufacturing costs. As opposed to prior arts, further, it also provides supreme design and extra safety to users when operating their tasks.

To reach aforementioned purpose, the invention proposes a toolbox structure mainly composed of main, left and right containers.

The main container has multiple storing slots on both of its longer sides for containing driver bits, a rectangular recess with two curved wall on the top, an inserting hole at the bottom of the rectangular recess for keeping a driver bit holder, and a connecting concave for connecting with a pivot connector.

The left and right containers are located on both sides of the main container, and have recessing windows and at their front ends. Inside the recessing windows set equally-spaced separating walls so as to make multiple positioning slots that match with the storing slots of the main container. Further, the said left and right containers have left and right fitting rings on the top respectively, and left and right shaft holes on the bottom respectively. The left and right fitting rings, and left and right shaft holes overlaps to each other when assembled. The left fitting ring further extends a hanger on its top with a hanging hole in the center. On the bottom of the left fitting ring sets a ringed groove for fitting with the ringed convexity located on top of the right fitting ring. The right fitting ring also has a ringed groove for fitting with the curved walls of the main container when assembling. The left and right shaft holes are employed to fit together with the pivot connector located at the bottom of the main container. With aforementioned, the left and right containers can, given the pivot connector as the pivot axis, rotate against the main container to open up or close the toolbox for loading or unloading driver bits.

BRIEF DESCRIPTION OF THE DRAWINGS

FIG. 7 at another angle FIG. 12 at another angle

DETAILED DESCRIPTION OF THE INVENTION

Figure 1:
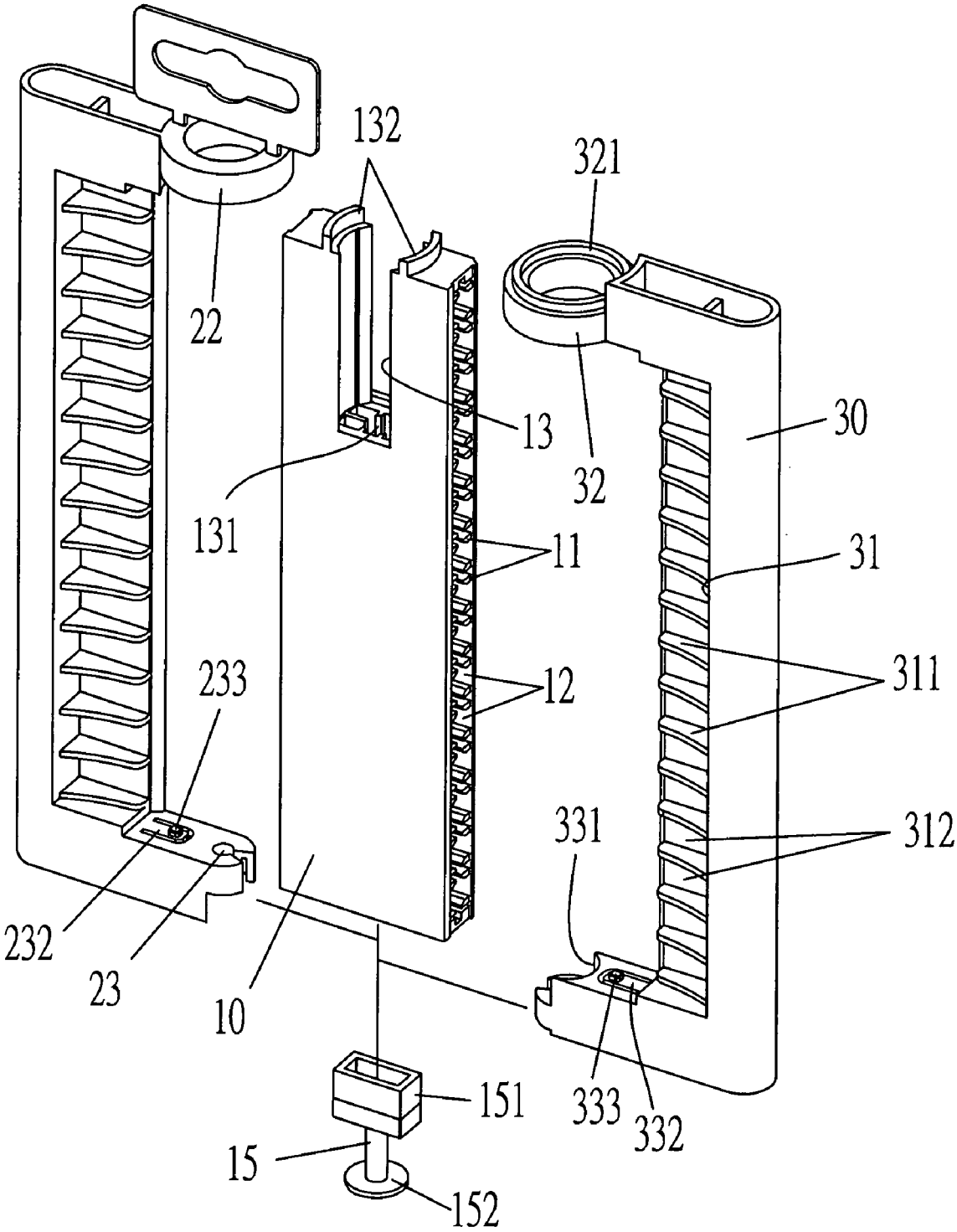
FIG. 1: An exploded view of the first preferred embodiment of the invention
Figure 2:
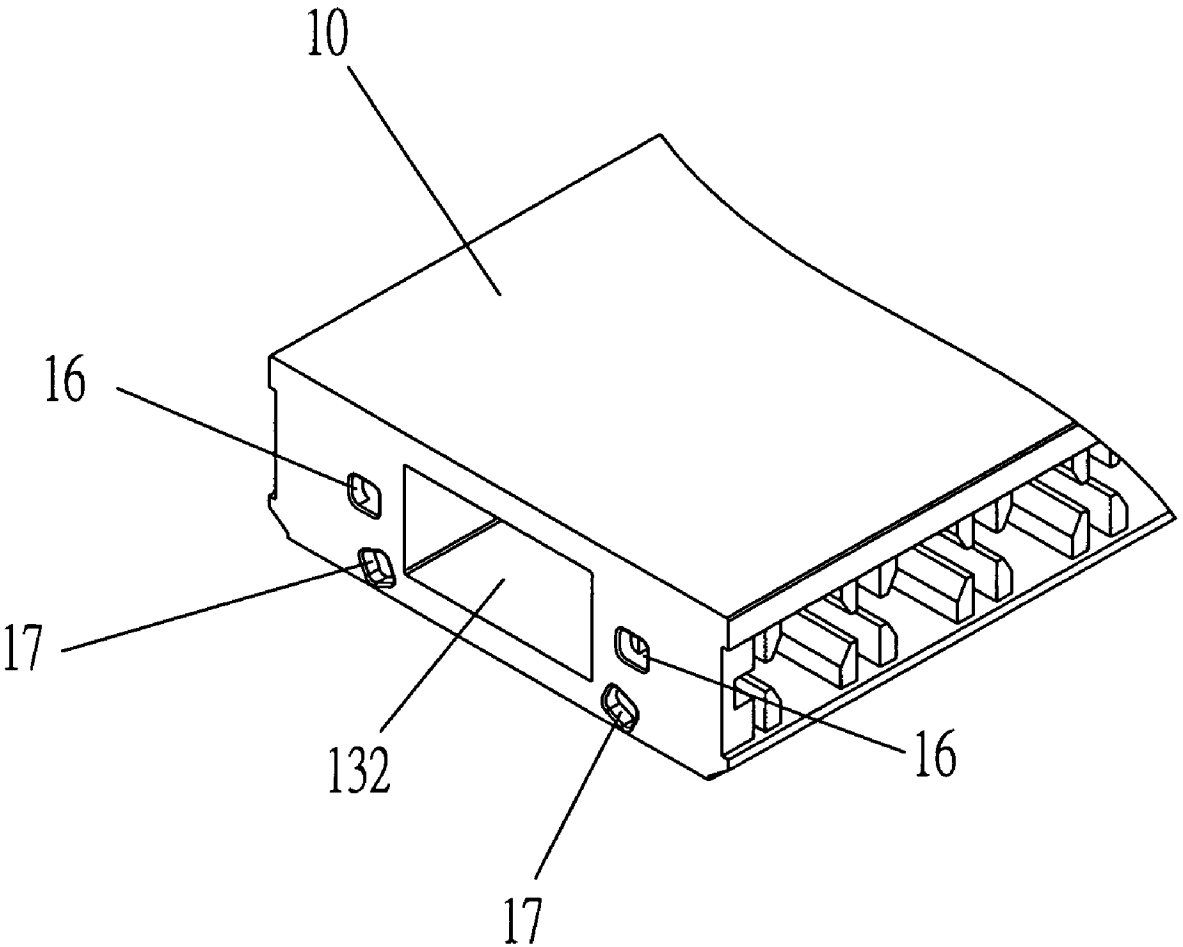
FIG. 2: A partial exploded view of the first preferred embodiment of the invention

A preferred embodiment of this invention is described as follows: First, FIG. 1-FIG. 9 show an overview of the preferred embodiment, which comprises: a main container 10, a left container 20 and a right container 30 (as shown in FIGS. 1 and 2).

The main container 10 is rectangular-shaped with proper dimension, concaved on both of the longer sides, and has multiple and symmetrical dividing walls 11 to form multiple equally-spaced storing slots 12 for containing driver bits (not shown in the figures); Moreover, in the center of the main container 10 sets a rectangular recess 13, and two curved walls 14 sharing same circle center. An inserting hole 131 penetrates from the bottom of rectangular recess 13 to the bottom of the main container 10 for keeping a driver bit holder (not shown in the figures); Further, at the bottom of the inserting hole 131 sets a connecting concave 132 for connecting with a pivot connector 15; The pivot connector 15 has a fitting body 151 with same shape as the connecting concave 132 in one side for fitting precisely with the connecting concave 132, and a stopping plate 152 to joint with and prevent right container 30 from loosing.

Figure 3:
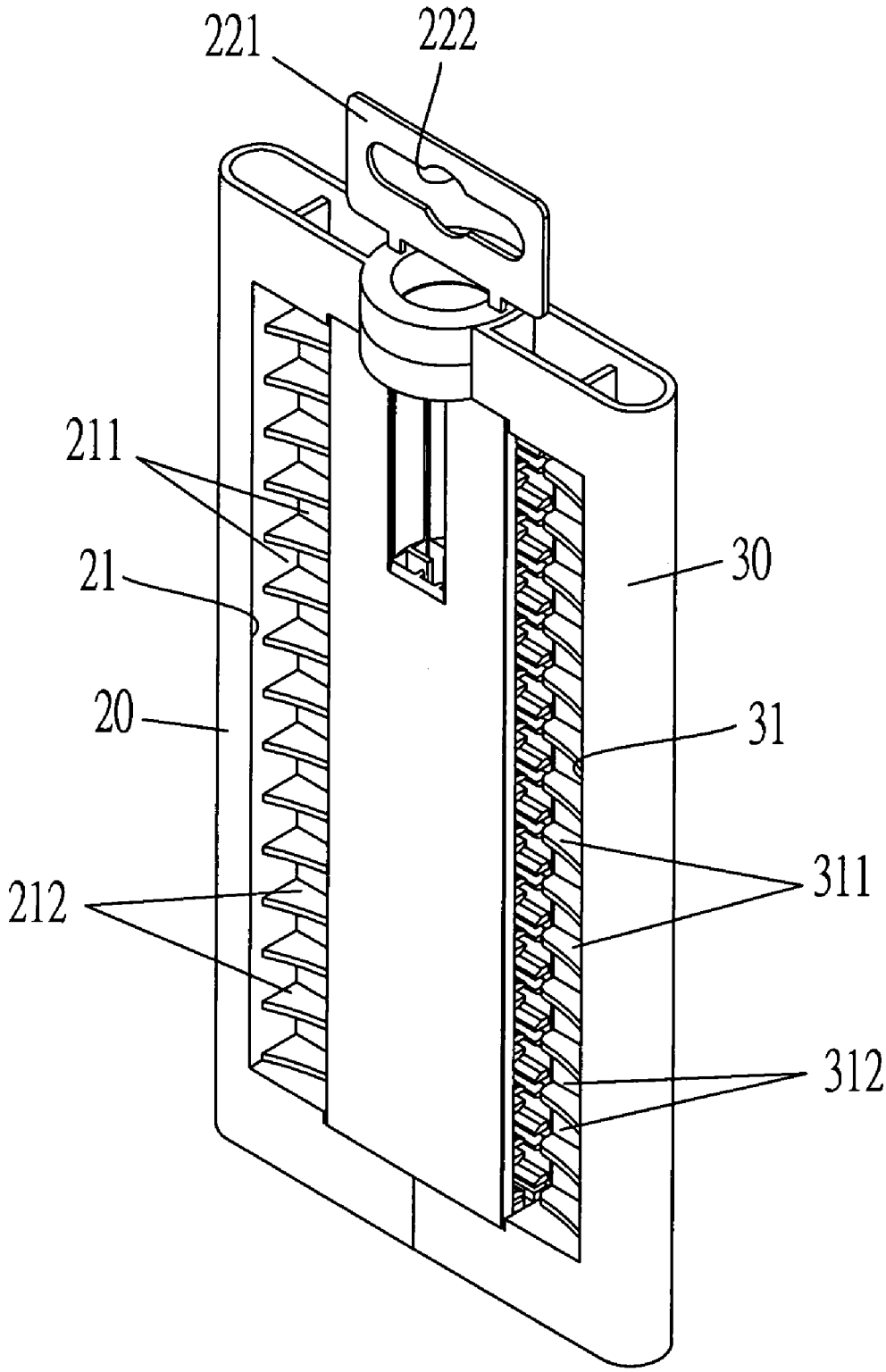
FIG. 3: A perspective view of the first preferred embodiment of the invention
Figure 4:
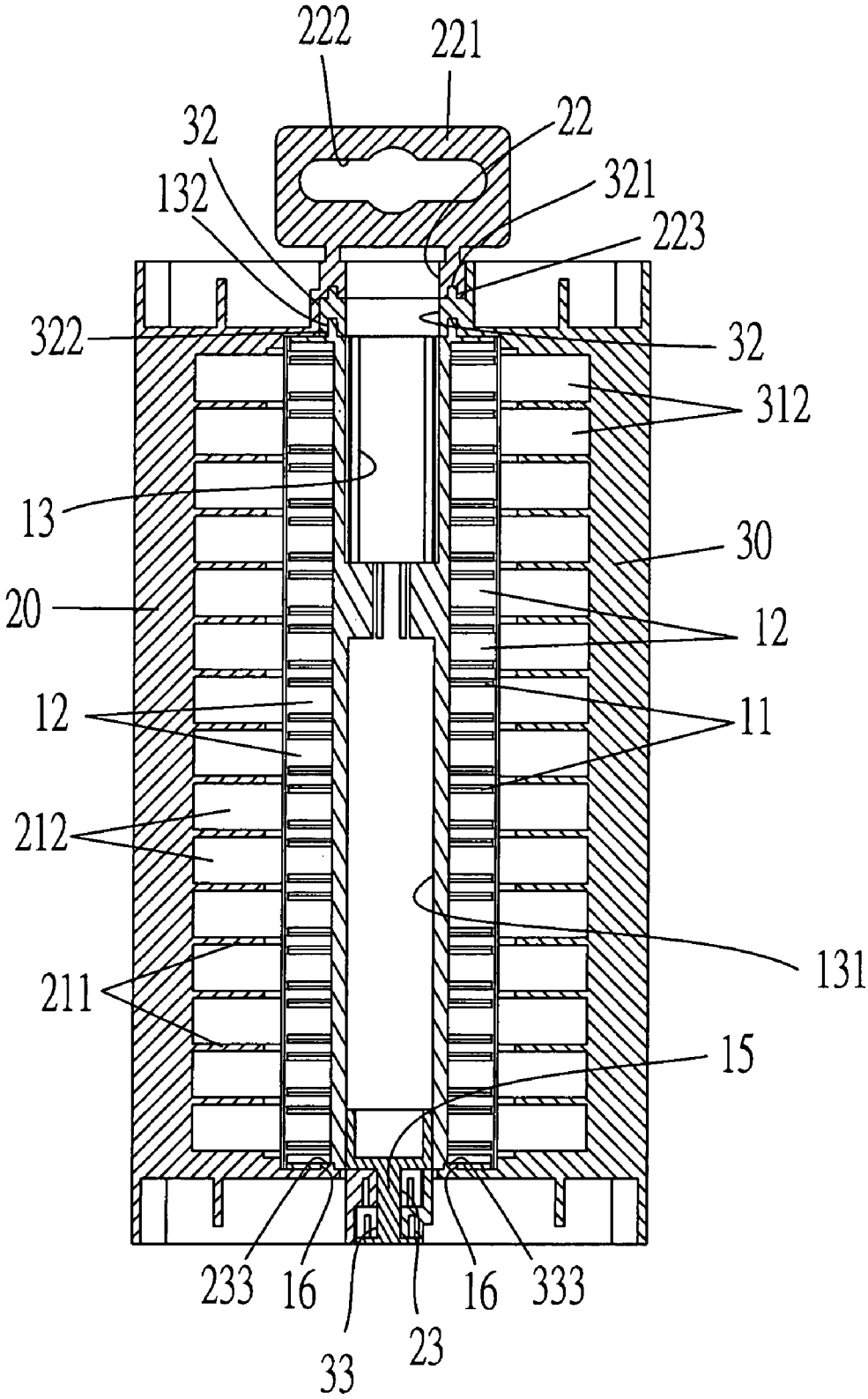
FIG. 4: A front sectional view of the first preferred embodiment of the invention
Figure 5:
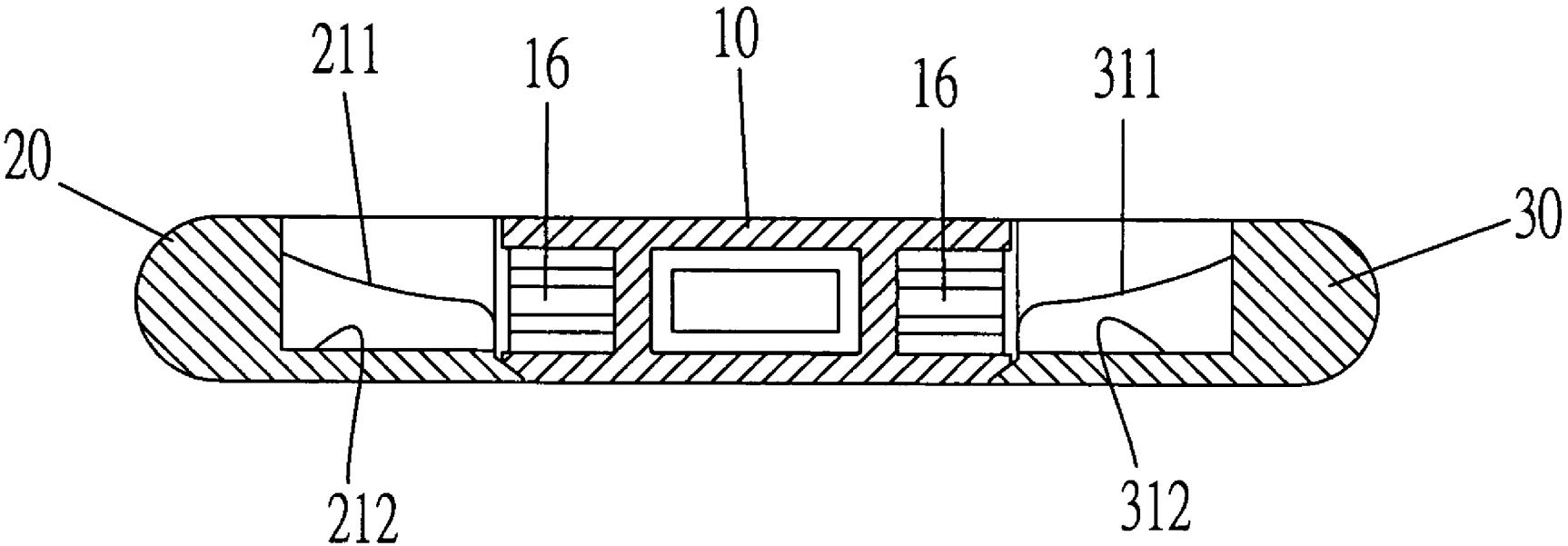
FIG. 5: A bird sectional view of the first preferred embodiment of the invention

The left and right containers 20, 30 located on both sides of the main container 10 have recessing windows 21 and 31 at their front ends. Inside the recessing windows 21, 31 set equally-spaced separating walls 211, 311 so as to make multiple positioning slots 212, 213, which fit with storing slots 12 (as shown in FIGS. 3-5); Further, the said left and right containers 20, 30 extend left and right fitting ring 22, 32 on the top respectively, and left and right shaft holes 23, 33 on the bottom respectively. The left, right fitting rings 22, 32 and shaft holes 23, 33 overlaps to each other when assembled; the left fitting ring 22 further extends a hanger 221 on its top with a hanging hole 222 in the center for hanging the product on shelves. On the bottom of the left fitting ring 22 sets a ringed groove 223 for fitting with the ringed convexity 321 located on top of the right fitting ring 32; The right fitting ring 32 also has a ringed groove 322 for fitting with the curved walls 14 of the main container 10 for assembly;

Moreover, the left and right shaft holes 23, 33 overlaps to each other at the bottom of the left, right containers 20, 30, and fit with the pivot connector 15 of the main container 10; The left and right shaft holes 23, 33 have left and right half-circled convexity respectively, and left and right limiting faces 231, 331 at their outer sides respectively, so that left half-circled convexity fits with right limiting face 331, and right half-circled convexity fits with left limiting face 231 (as shown in FIGS. 7-9);

With aforementioned structure, the invention of a tool container has fewer components than prior arts and features of quick installation, easy use, and lower manufacturing costs. Thus, it proposes more advanced capabilities that prior arts cannot offer. Please be described of further supplemental information for practical usage as follows. The left and right containers 20, 30, given the pivot connector 15 as the pivot axis, can be rotated backwards to open up for load or unload of driver bits.

Further, as shown in FIGS. 1 and 2, at the bottom of the main container 10 set a symmetrical pair of closing positioning cavities 16 and opening positioning cavities 17 for left and right containers 20, 30 being well positioned when they are closed or opened up. The left and right containers have spring bands 232, 332 respectively that are set close to the left and right shaft holes at proper positions and have convex point 233 and 333 respectively, which can fit with aforementioned closing positioning cavities 16 and opening positioning cavities 17. That is, when the left, right containers are closed against the main container 10, the convex points 233, 333 would fit with the closing positioning cavities 16. When the left, right containers are opened against the main container 10, the convex points 233, 333 would fit with the closing positioning cavities 17.

Figure 6:
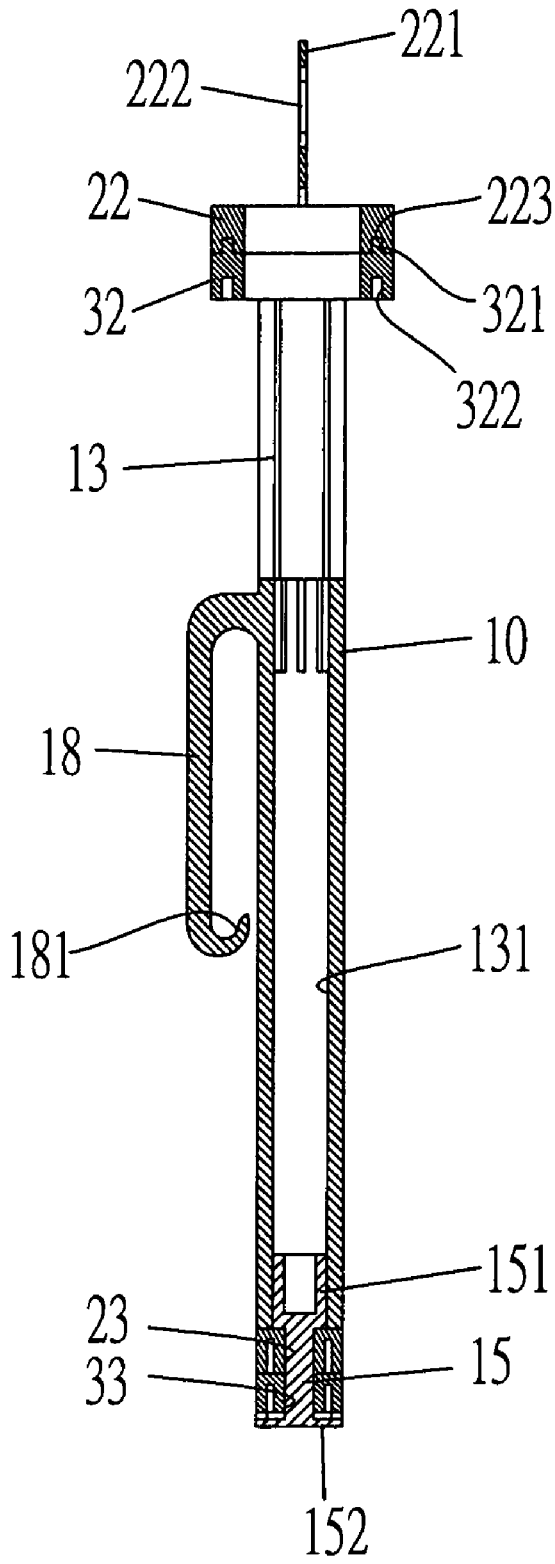
FIG. 6: A side sectional view of the first preferred embodiment of the invention
Figure 7:
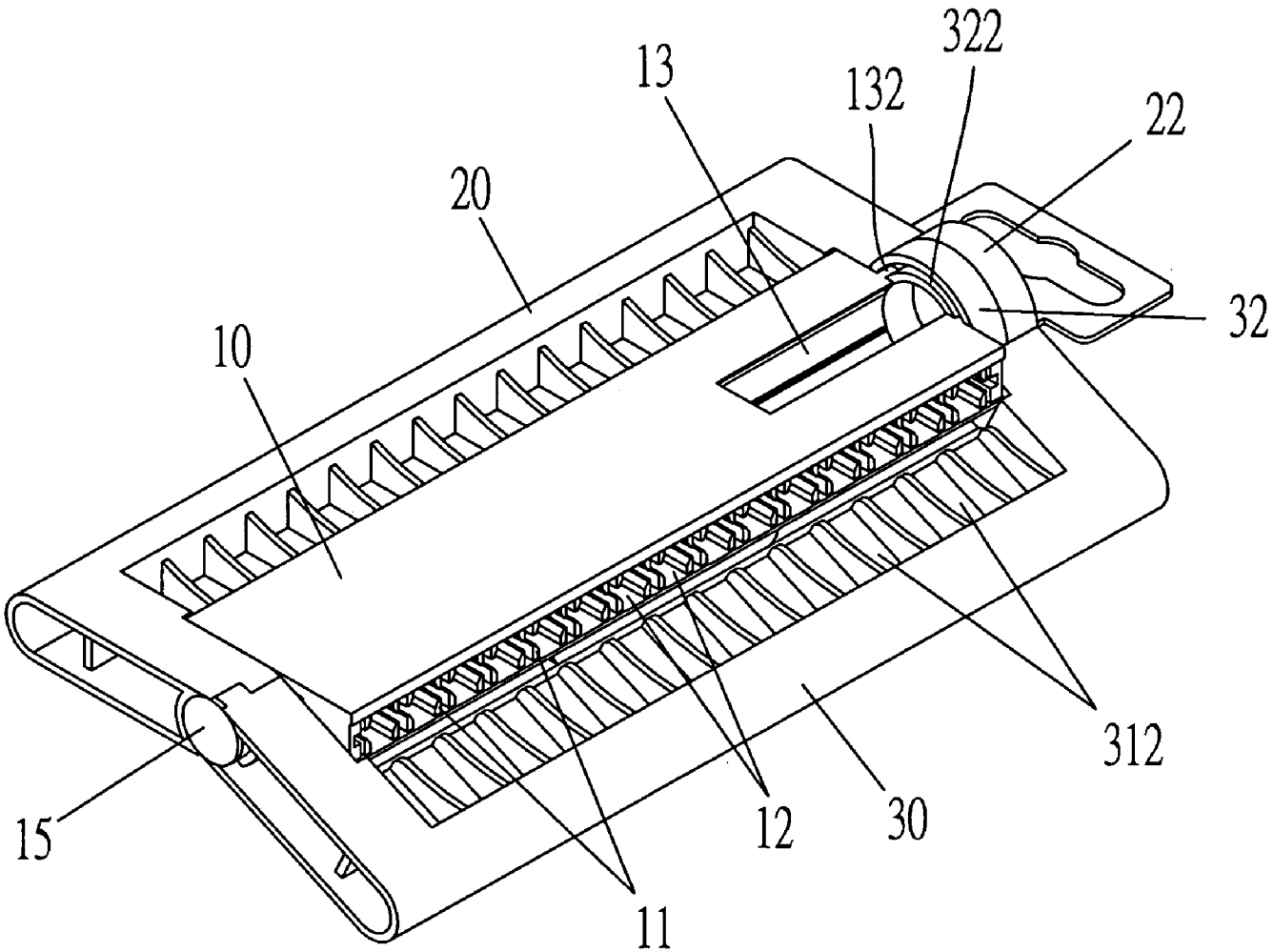
FIG. 7: An open-up view of right container of the first preferred embodiment of the invention
Figure 8:
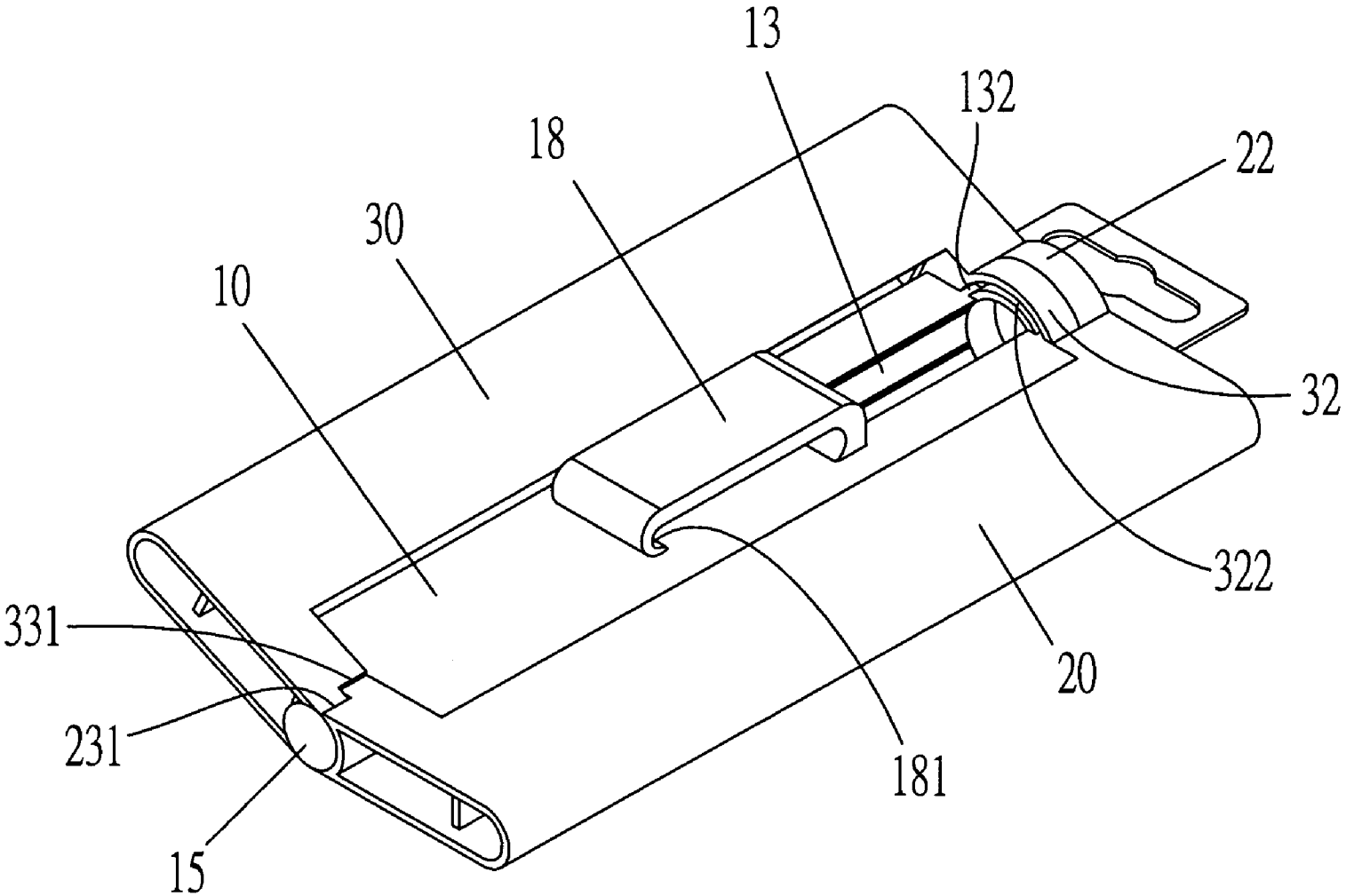
FIG. 8.
Figure 9:
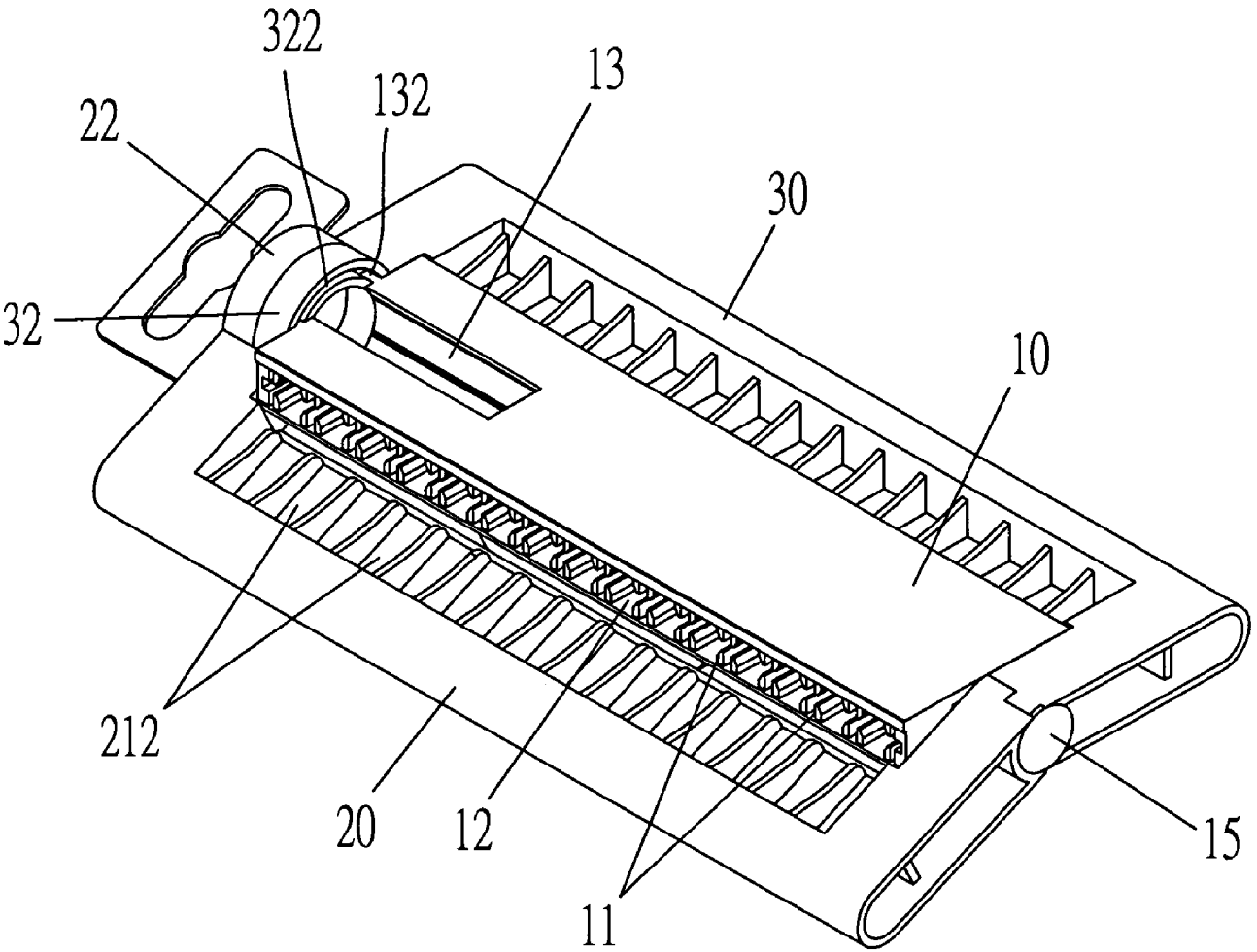
FIG. 9: An open-up view of left container of the first preferred embodiment of the invention

Furthermore, as shown in FIGS. 6 to 8, the preferred embodiment of the invention proposes a structure that makes it easy for users to carry on with them. A rectangular clip 18, which has a hook 181, is set close to the rectangular recess 13 on one side of the main container 10, so that the toolbox can be clipped on the belts of the users with the rectangular clip 18 for easy carry-on.

Below refers to a technically equivalent extension of proposed structure of the invention, which makes the best use out of this invention.

Figure 10:
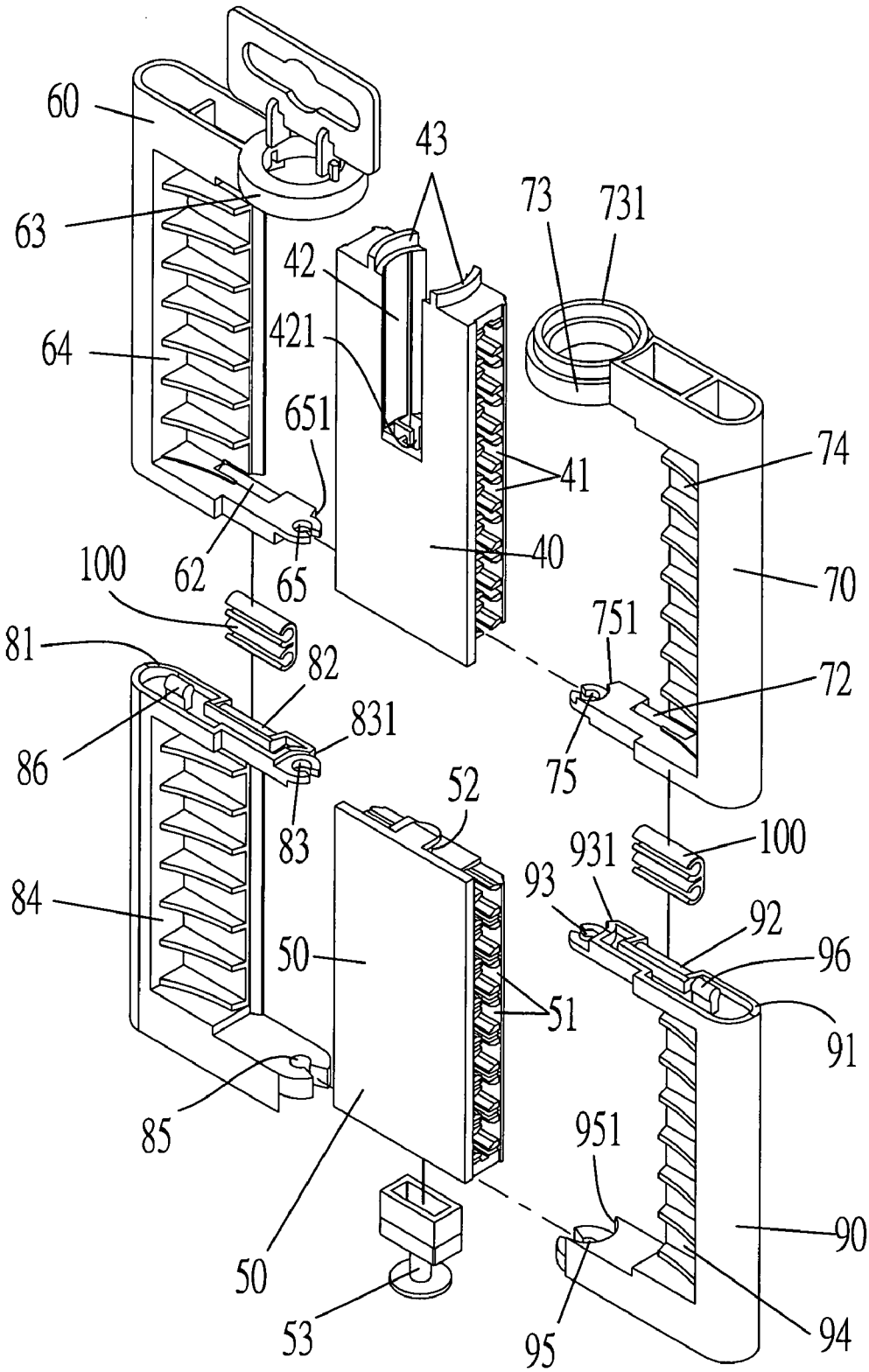
FIG. 10: A front exploded view of the second preferred embodiment of the invention
Figure 11:
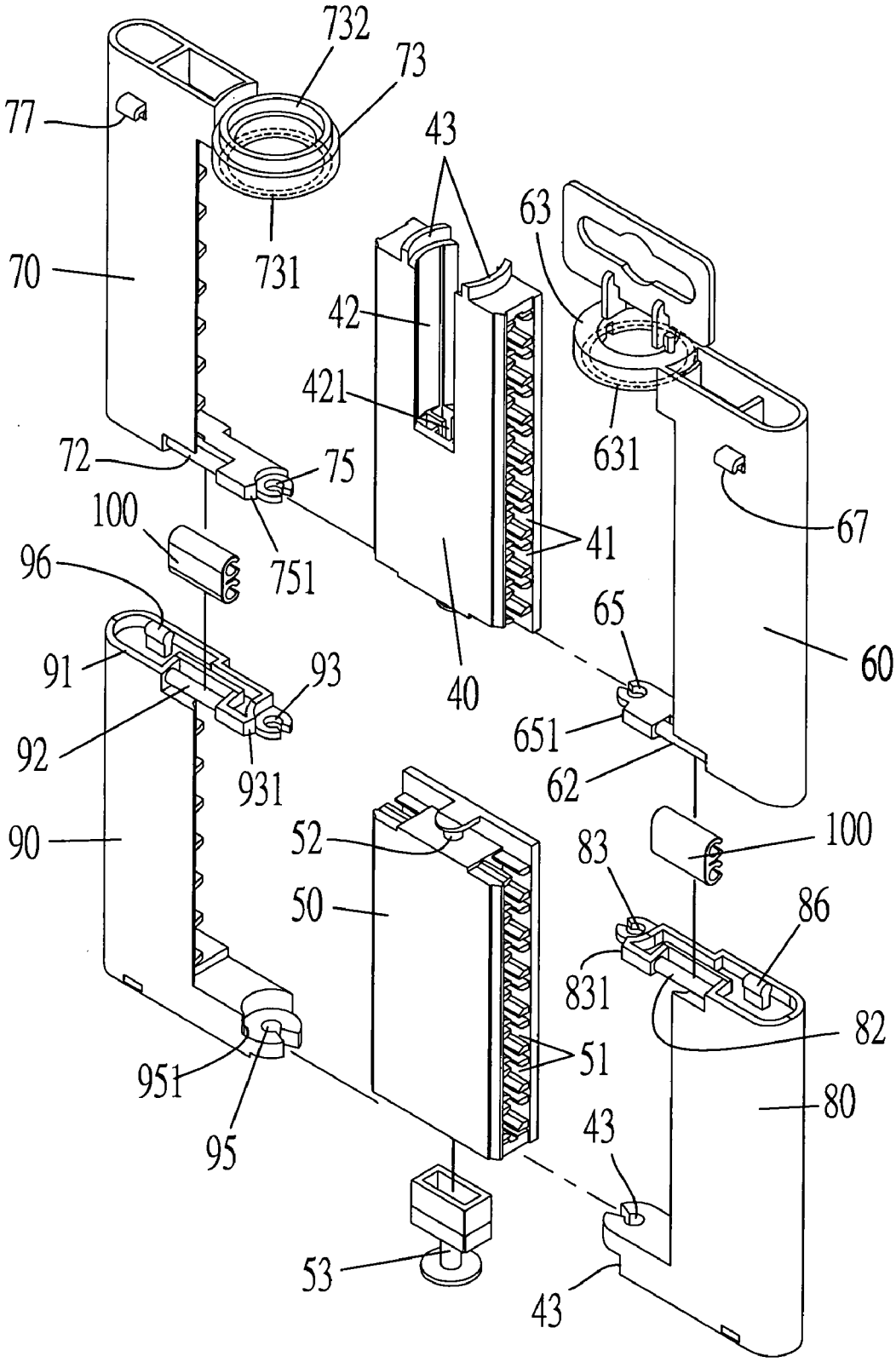
FIG. 11: A back exploded view of the second preferred embodiment of the invention
Figure 12:
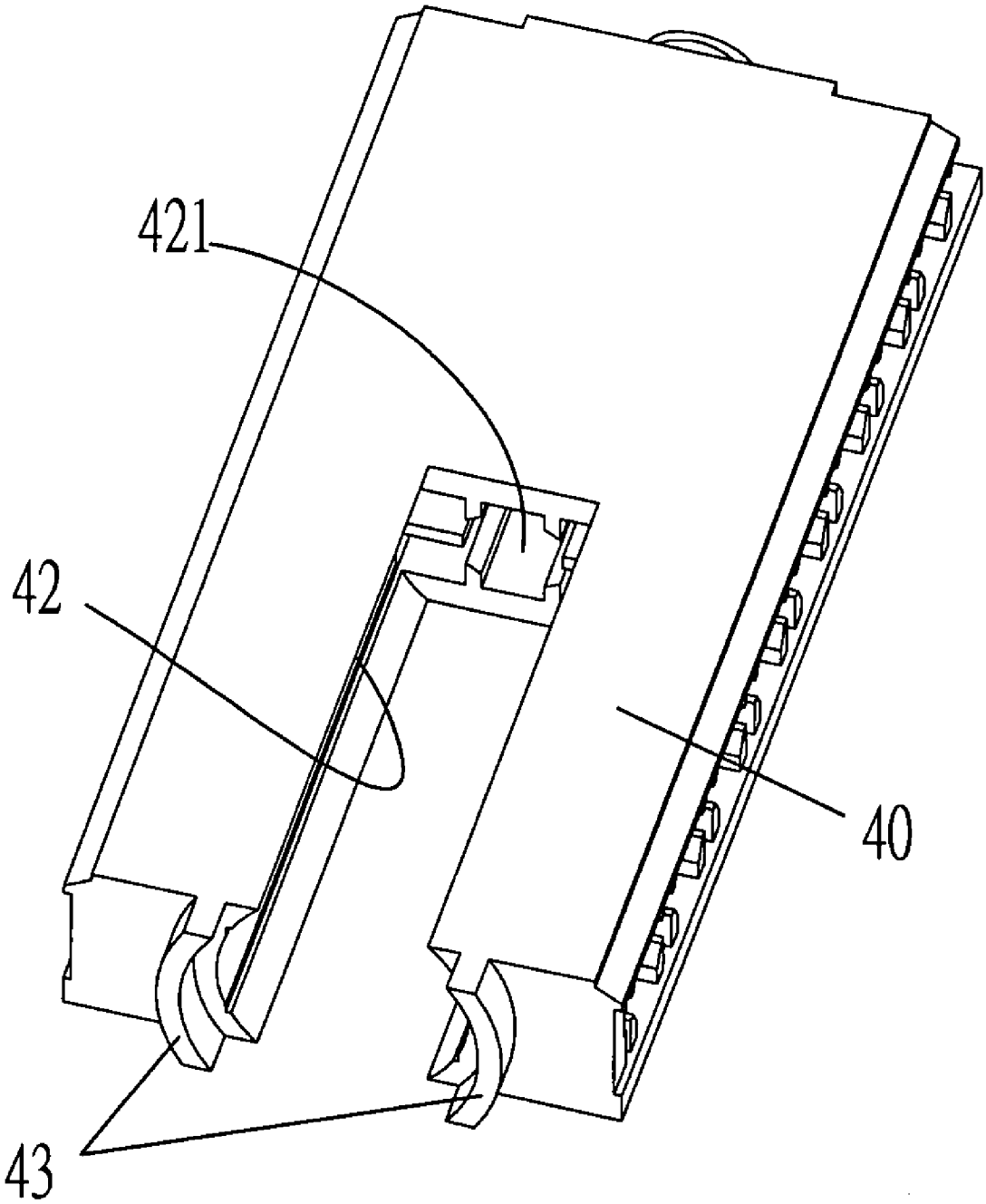
FIG. 12: A perspective view of upper main container of the second preferred embodiment of the invention
Figure 13:
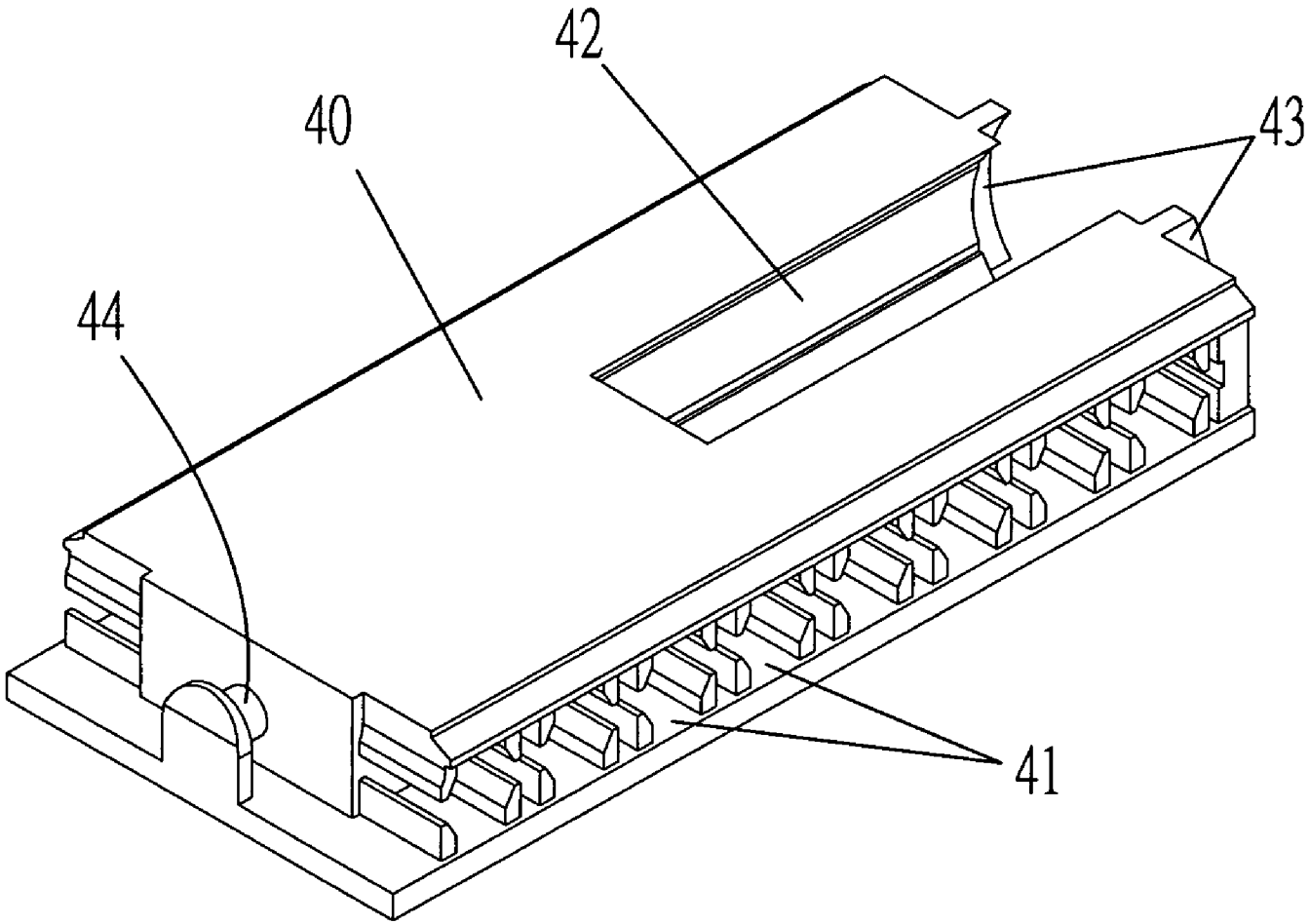
FIG. 13.
Figure 14:
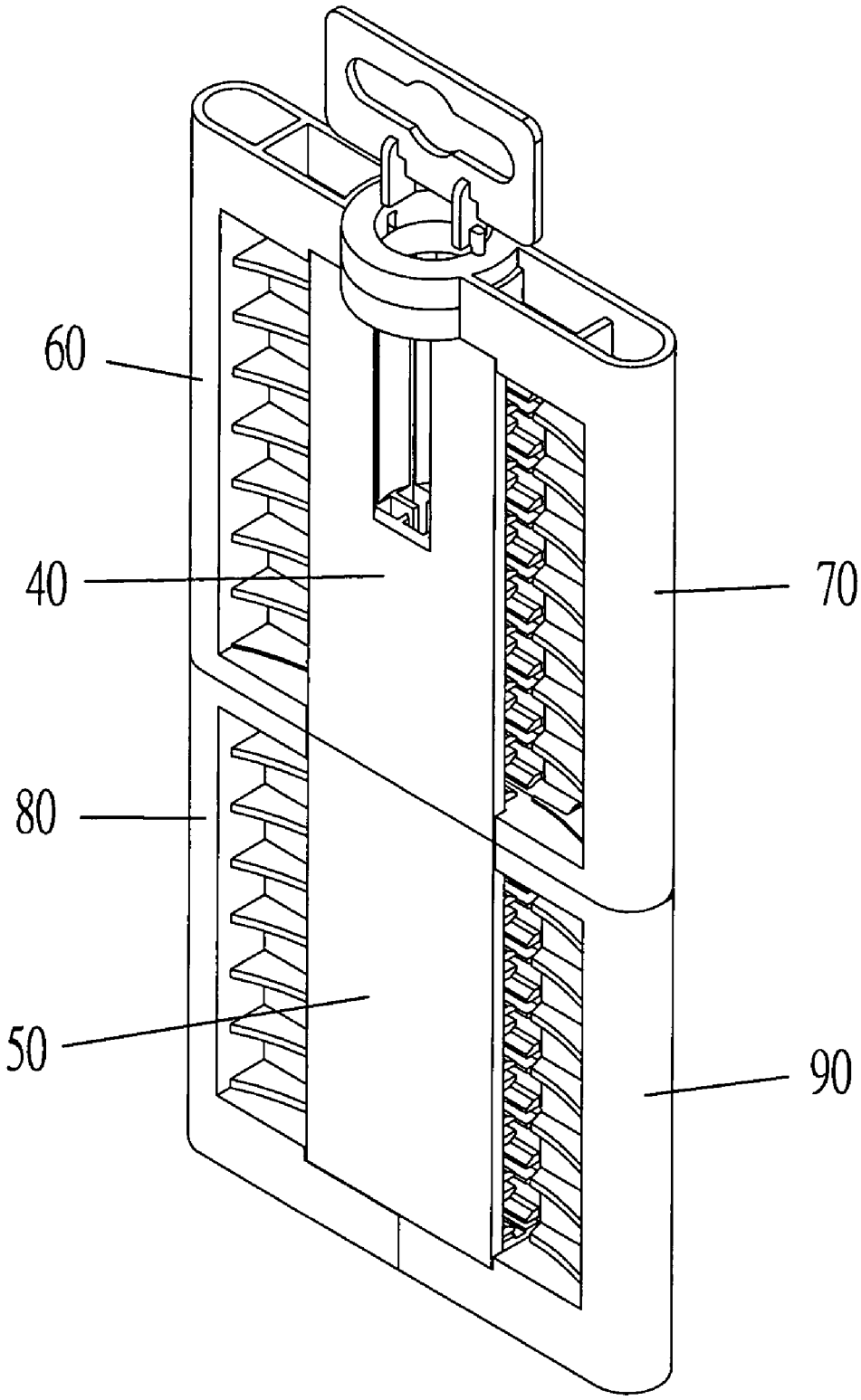
FIG. 14: A perspective view of the second preferred embodiment of the invention.
Figure 15:
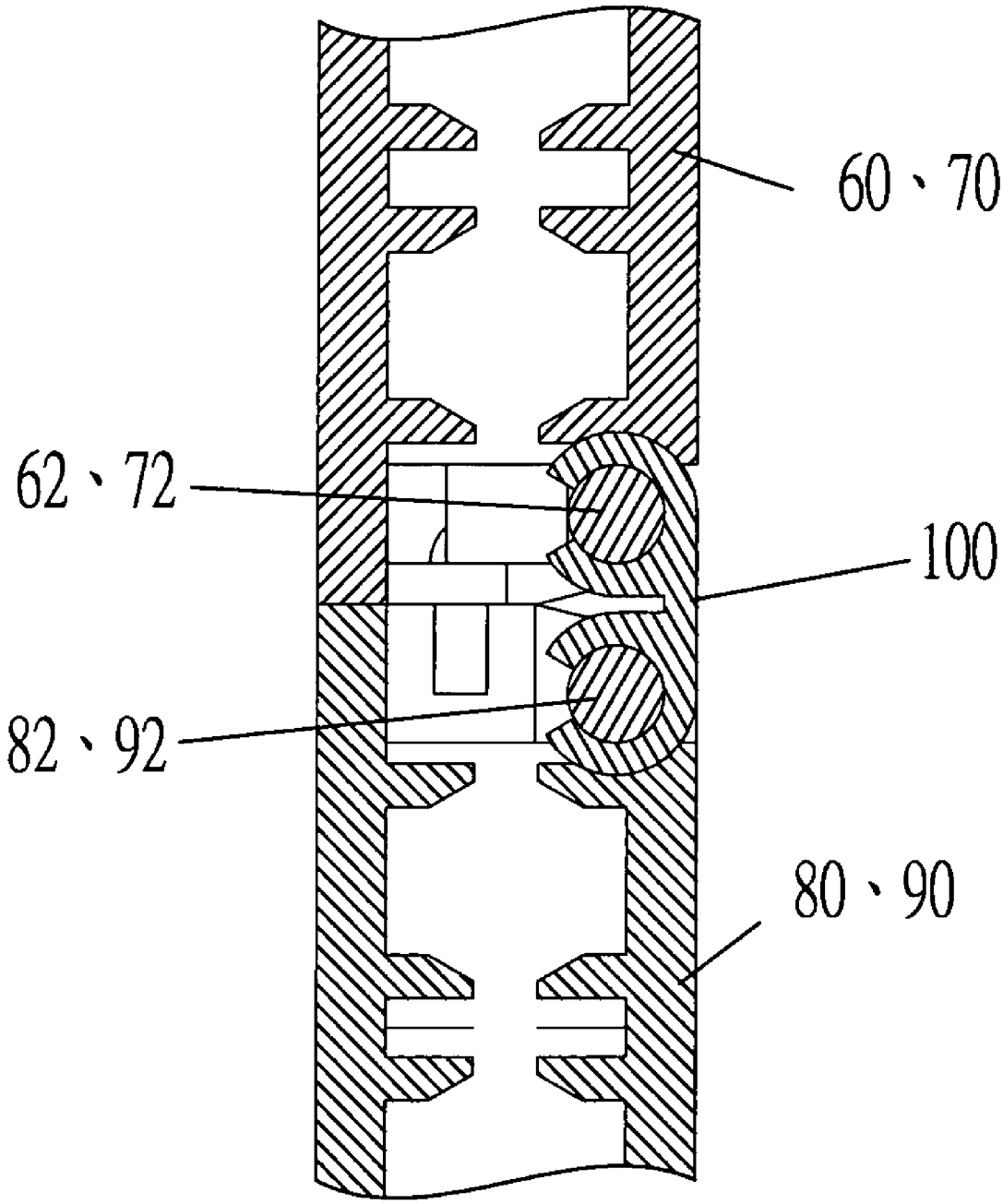
FIG. 15: A partial side sectional view of the second preferred embodiment of the invention
Figure 19:
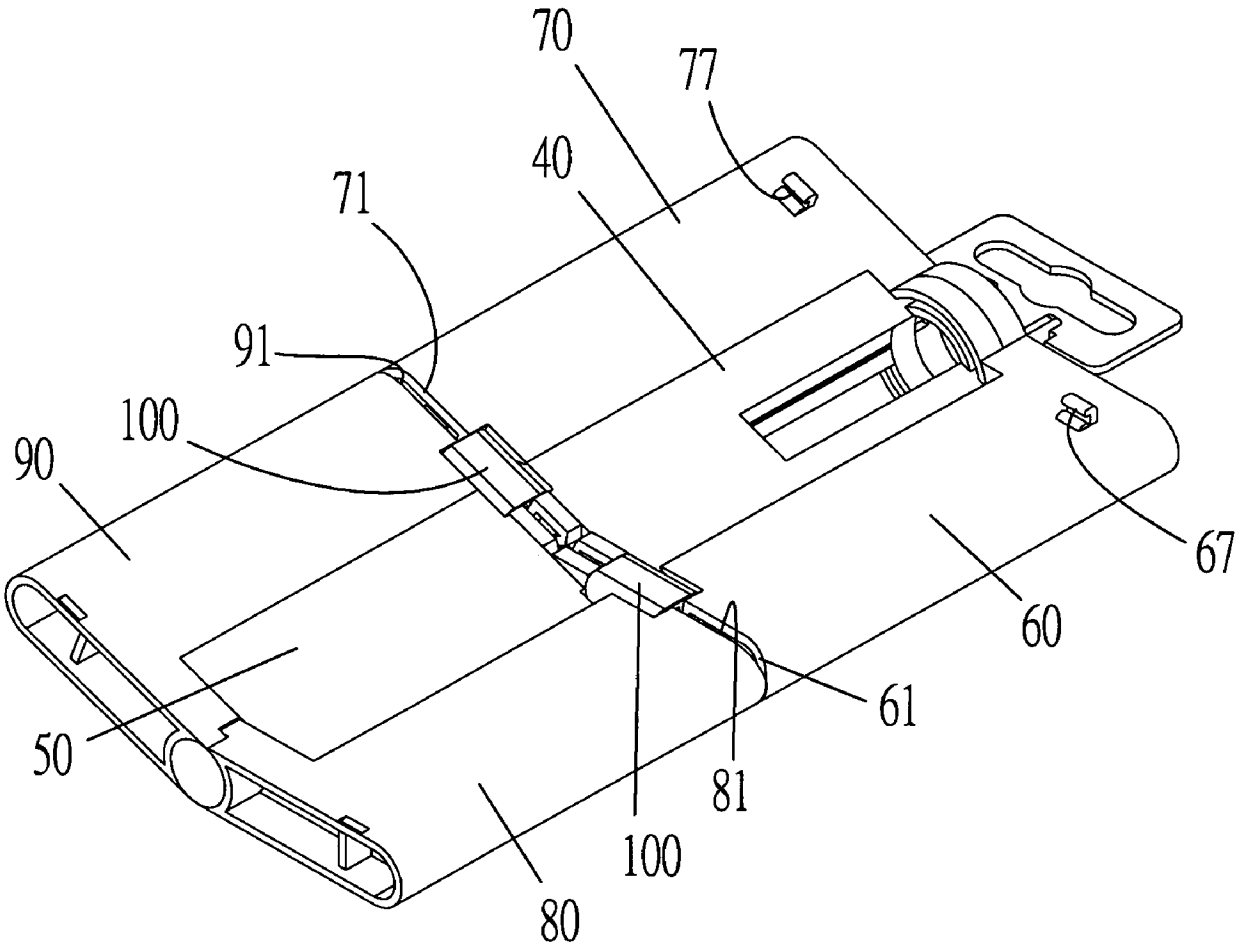
FIG. 19: A back view of FIG. 18

With reference to FIGS. 1 and 10 to 19, below described is the second preferred embodiment that shows a technically equivalent extension of proposed structure of the invention. The main improvement is to further divide main, left and right containers into upper main, left and right containers 40, 60, 70 respectively, and lower main, left and right containers, 50, 80, and 90 respectively. The detailed descriptions are as follows:

First, upper left and right containers 60, 70 are mounted on both sides of and can be rotated against the upper main container 40. And, the same fashion of above mechanism applies to lower main, left and right containers 50, 80, and 90. Second, at the bottom of upper left, right containers 60, 70 and on the top of lower left, right containers 80, 90 have slant faces 61, 71, 81, and 91 respectively that fit in shape mutually between upper and lower left containers 60, 80, and between upper and lower right containers 70, 90. Also, symmetrical joint rods 62, 72, 82, and 92 are respectively facilitated at the bottom of both upper left, right containers 60, 70 and on top of left, right containers 80, 90. And then, two rod joints 100 are used to respectively connect both upper and lower left containers 60, 80 by fitting with joint rods 62, 82, and connect both upper and lower right containers 70, 90 by fitting with joint rods 72, 92. (As shown in FIGS. 10, 11 and 19)

There are multiple storing slots 41, 51 on both of the longer sides of upper and lower main containers 40 and 50 respectively for storing driver bits. (Not shown in the figures) Moreover, in the center of the upper main container 40 sets a rectangular recess 42, and two curved walls 43 sharing same circle center, which are facilitated to fit with the ringed groove 732 of the upper right fitting ring 73. An inserting hole 421 is set at the bottom of rectangular recess 42 for keeping a driver bit holder (not shown in the figures). At the bottom of upper main container 40 sets a lower rod 44, on top of the lower main container 50 sets a upper rod 52, and at the bottom of the lower main container 50 sets a pivot connector 53.

Further, the upper left, upper right and lower left, lower right containers 60, 70, 80, and 90 have recessing windows 64, 74, 84, and 94 respectively at their front ends, which match with both the longer sides of the upper and lower main containers 40, and 50. On the top of upper left and right containers 60, 70 respectively set upper left and upper right fitting rings 63, and 73 that overlap when fitting. At the bottom of upper left and right containers 60, 70 respectively set upper left and upper right shaft holes 65, and 75 that overlap when fitting. The upper left and upper right fitting rings 63, and 73 respectively sets a ringed groove 631 and ringed convexity 731 for fitting together, and further at the bottom of the upper right fitting rings 73 sets a ringed groove 732 for fitting with the curved walls 43 of the upper main container 40. The upper left and upper right shaft holes 65, and 75 can fit with the lower rods 44 at the bottom of the upper main container 40, and on their outer side have limiting faces 651, and 751 respectively to confine the rotation angle of both upper left and right containers 60, and 70.

On top of the lower left and right containers 80, and 90 respectively extend upper left and right shaft holes 83, and 93 that overlap when fitting, and at their bottom respectively extend lower left and right shaft holes 85, and 95 that overlap when fitting. The upper left and right shaft holes 83, and 93 can fit with the upper rod 52 of the lower main container 50, while the lower left and right shaft holes 85, and 95 can fit the pivot connector 53 at the bottom of the lower main container 50. Further, on the outer and backside parts of the upper left and right shaft holes 83, 93, and the lower left and right shaft holes 85, 95 respectively have limiting faces 831, 931, 851, and 951 for confining the rotation angle of both lower left and right containers 80, and 90.

With aforementioned structures, the lower left and right containers 80, and 90 can be folded backwards (FIGS. 15 to 17) with the rod joint 100 as the pivot axis so as to enable dimension shift for easy carry-on purpose.

Figure 17:
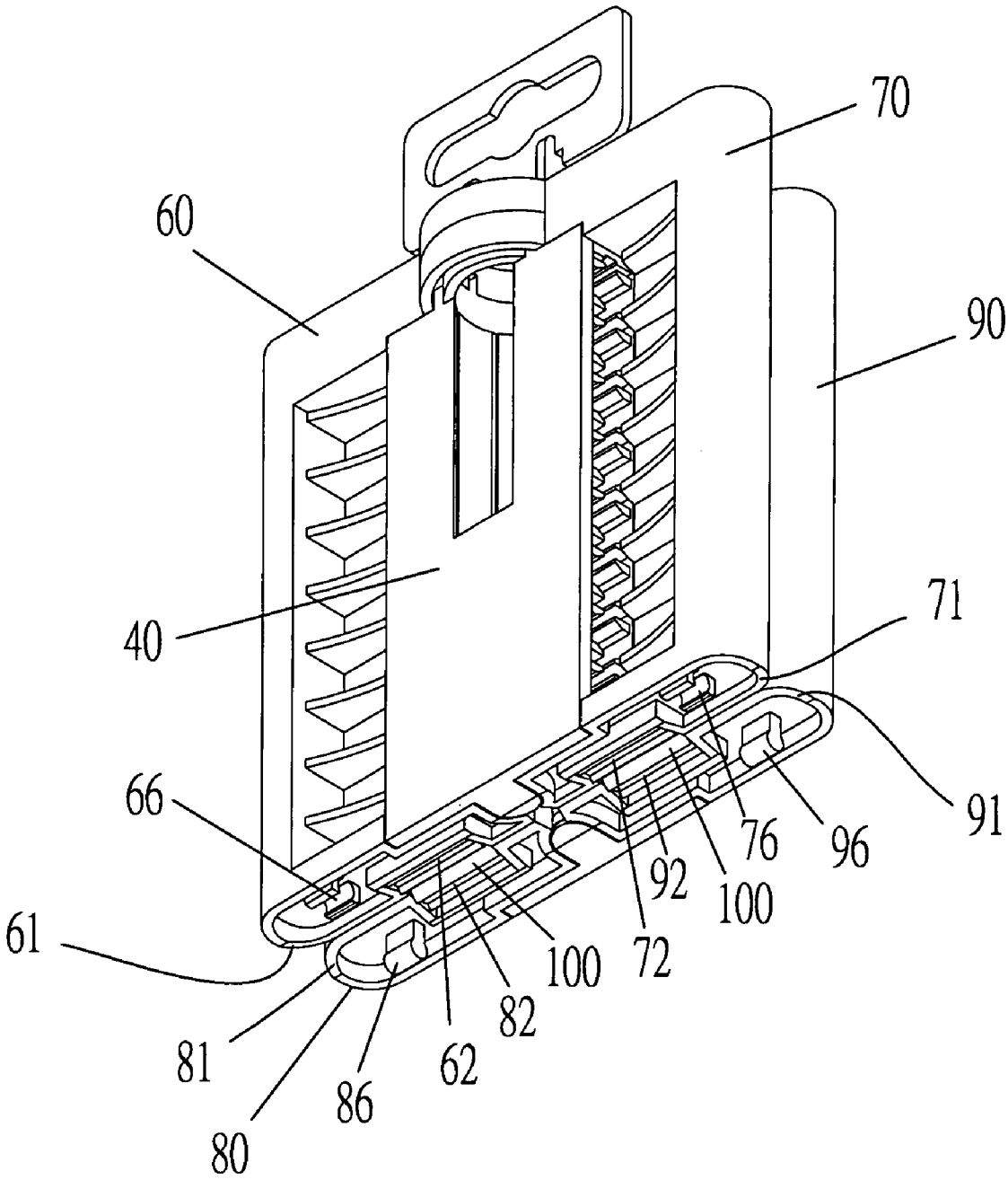
FIG. 17: A back view of the second preferred embodiment of the invention when folded
Figure 18:
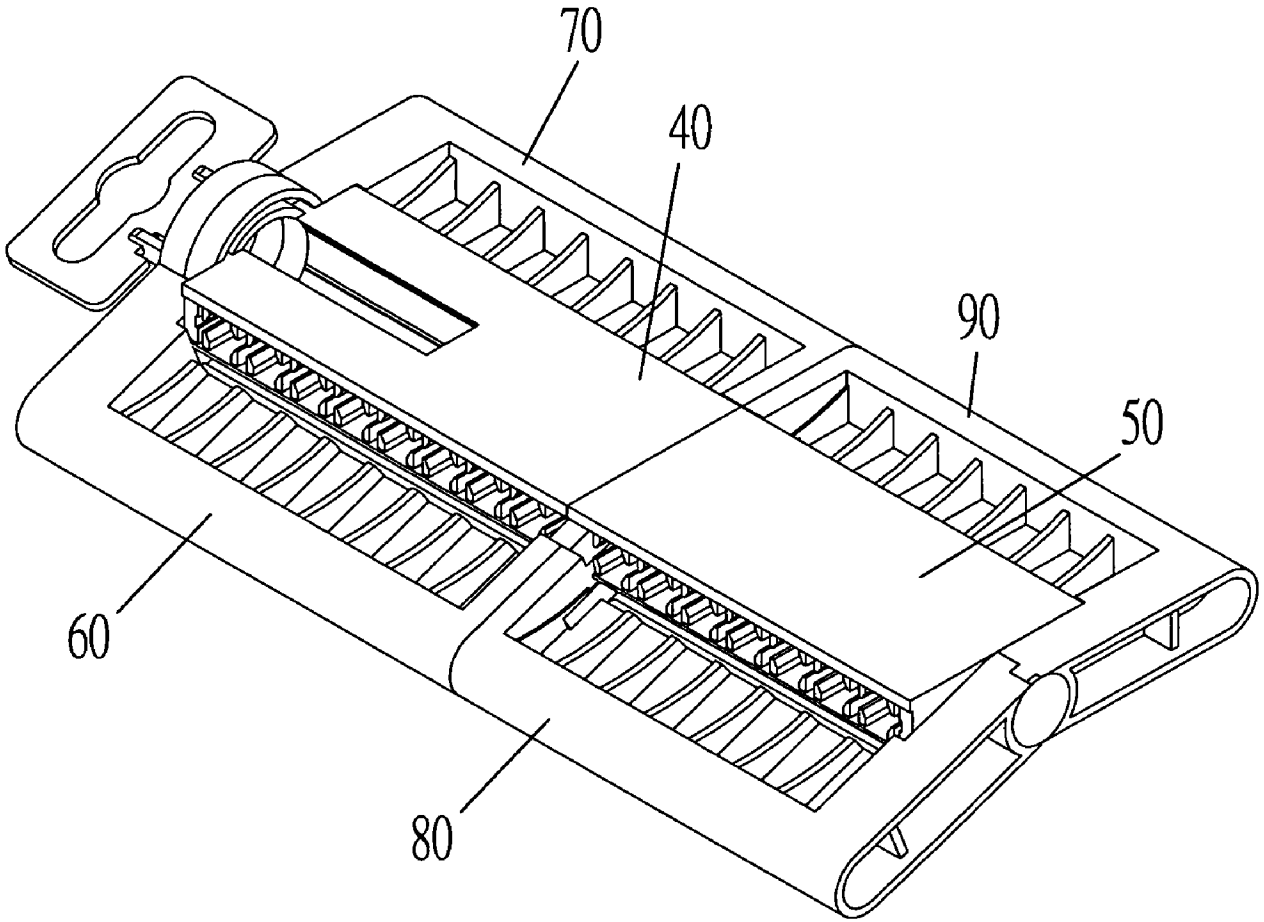
FIG. 18: A rotation view of left container of the second preferred embodiment of the invention

Further, On the face of joint as shown in FIGS. 10 and 17, the upper left and right containers 60 and 70 respectively set fitting grooves 66, and 76, and the lower left and right containers 80 and 90 respectively set fitting convexities 86, and 96. When the upper and lower containers are jointed vertically, the positioning can be more firmly assured by inserting the fitting convexities 86, 96 into grooves 66, 76 together.

Figure 16:
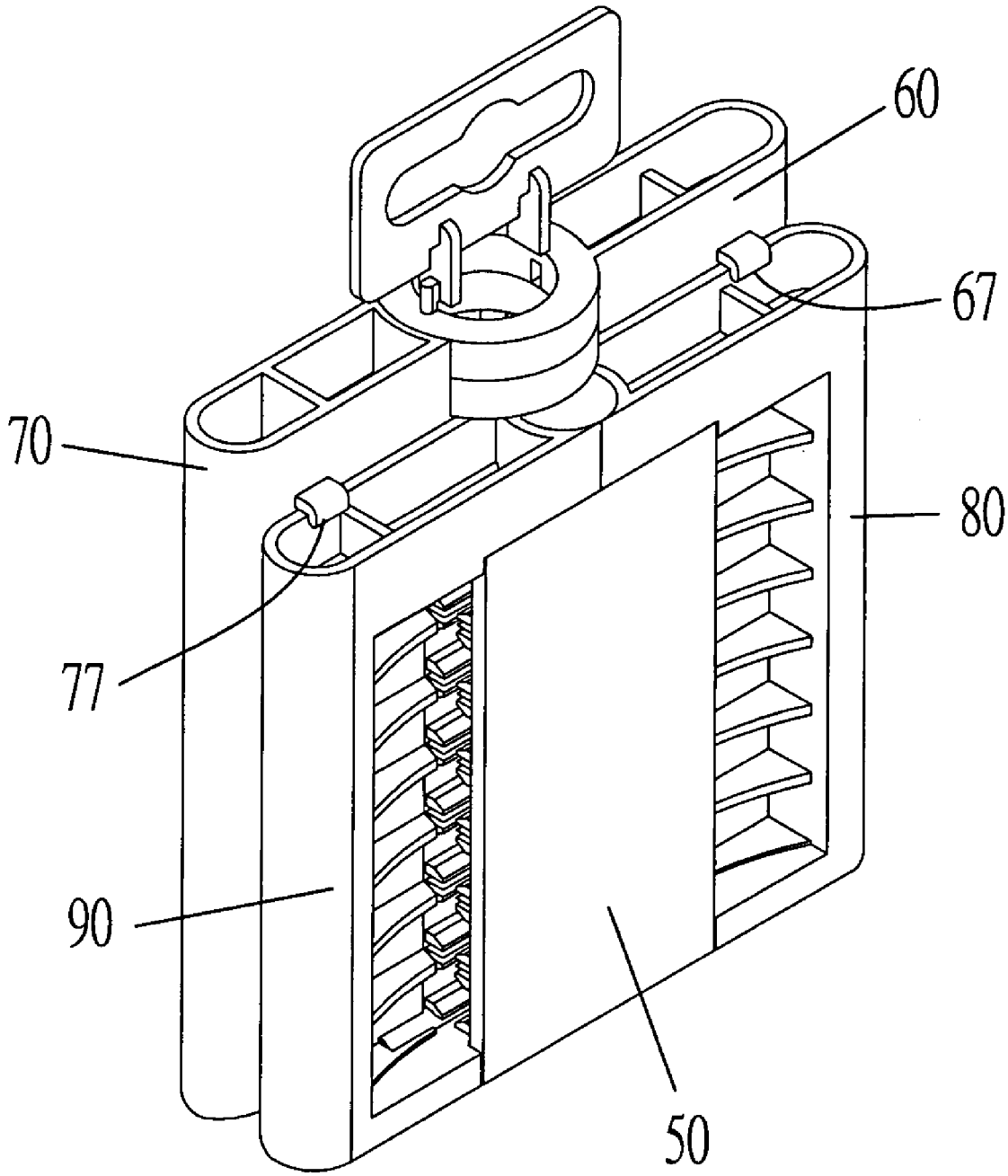
FIG. 16: A front view of the second preferred embodiment of the invention when folded

Furthermore, as shown in FIGS. 11, 16, and 19, two safety hooks 67, and 77 are symmetrically set at the backside of the upper left and right containers 60, 70 so as to grab the lower left and right containers 80, 90 at the walls of their bottom to ensure firm positioning when they are folded.

With all aforementioned, the invention deserves grant of a patent based on its capability of industrial application and absolute novelty. The example illustrated above is just an exemplary embodiment for the invention, and shall not be utilized to confine the scope of the patent. Any equivalent modifications within the scope of claims of the patent shall be covered in the protection for this patent.

What is claimed is:

1. A toolbox structure comprising: a rectangular main container that has multiple storing slots on both sides of the rectangular main container, two symmetrical curved walls on its top and a pivot connector at the bottom; two symmetrical left and right containers that are respectively located on both sides of the said main container, have recessing windows matching with longer sides of the said main container, and have overlapping left and right fitting rings respectively on their top and overlapping left and right shaft holes respectively at their bottom; the said left and right fitting rings are set to fit with the said curved walls and the left and right shaft holes are to fit with the said pivot connector, so as to connect the said left and right containers with the said main container; and at outer sides of the said left and right shaft holes set left and right limiting faces respectively to confine the rotation angle of the said left and right containers against the said main container.

2. A toolbox structure of claim 1, wherein the said main container has a rectangular recess that has two symmetrical curved walls on the top to fit with a ringed groove located at the bottom of the said right fitting ring, and has an inserting hole at the bottom for keeping a driver bit holder.

3. A toolbox structure of claim 1, wherein the said recessing windows of the said left and right containers have multiple separating walls to form multiple positioning slots that match with the storing slots of the said main container.

4. A toolbox structure of claim 1, wherein the said left fitting ring further extends, on its top, a hanger that has a hanger hole for hanging purpose.

5. A toolbox structure of claim 1, wherein the said left fitting ring sets a ringed groove at the bottom for fitting with a ringed convexity set on top of the said right fitting ring.

6. A toolbox structure of claim 1, wherein the said right fitting ring has a ringed groove at the bottom for fitting with the said curved walls of the said main container.

7. A toolbox structure of claim 1, wherein the said main container has symmetrical closing and opening positioning cavities at the bottom, and the said left and right containers have spring bands respectively that are set close to the said left and right shaft holes at proper positions and have convex points, which can fit with the said closing and opening positioning cavities.

8. A toolbox structure of claim 1, wherein the said main container has, at its back, a rectangular clip used to clip the toolbox onto users.

9. A toolbox structure comprising: an upper main container with upper left and right containers coupled on its both sides, and an lower main container with lower left and right containers coupled on its both sides; at a bottom of the said upper left and right containers and on top of the said lower left and right containers set mutually fitted slant faces and symmetrical joint rods; two rod joints are employed to joint the said upper and lower left containers, and the said upper and lower right containers by fitting with the said joint rods, wherein the said upper left, upper right, lower left and lower right containers have recessing windows matching with the longer sides of the said upper and lower main container, wherein the said upper left and right containers have overlapping upper left and right fitting rings respectively on their tops and overlapping upper left and right shaft holes respectively at their bottoms; and the upper left and right fitting rings are employed to fit with the curved walls of the said upper main container, and the upper left and right shaft holes are employed to fit with the lower rods set at the bottom of the said upper main container; and at outer sides of the said upper left and right shaft holes set limiting faces respectively so as to confine the rotation angle of the said upper left and right containers against the said upper main container, wherein the said lower left and right containers have, on their tops and bottoms, upper left and right shaft holes, and lower left and right shaft holes; The said upper left and right shaft holes are employed to fit with upper rods set on top of the said lower main container; and the said lower left and right shaft holes are employed to fit with the pivot connector set at the bottom of the said lower main container; and at outer sides of the said upper left, upper right, lower left and ldwer right shaft holes set limiting faces respectively so as to confine the rotation angle of the said upper left and right containers against the said lower main container, wherein the said upper left, upper right, lower left and lower right containers have symmetrical fitting grooves and corresponding fitting convexities for more firm positioning when assembled vertically, wherein the said upper left and right containers have symmetrical safety hooks at their backs for hooking the said lower left and right containers when they are folded.

10. A toolbox structure of claim 9, wherein the said upper main container has a rectangular recess that has two symmetrical curved walls on the top to fit with a ringed groove located at a bottom of an upper right fitting ring, and has an inserting hole at the bottom for keeping a driver bit holder.

11. A toolbox structure of claim 9, wherein the said upper and lower main containers have multiple storing slots on both sides for storing driver bits.

* * * * *